US007695421B2

(12) United States Patent
Ford

(10) Patent No.: US 7,695,421 B2
(45) Date of Patent: Apr. 13, 2010

(54) ROTARY CARTON FEEDER

(75) Inventor: Colin Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 596 days.

(21) Appl. No.: 11/344,706

(22) Filed: Feb. 1, 2006

(65) Prior Publication Data

US 2007/0257416 A1 Nov. 8, 2007

(51) Int. Cl.
*B31B 1/80* (2006.01)
*B65H 3/12* (2006.01)

(52) U.S. Cl. ..... 493/315; 271/91; 271/95; 271/99; 271/100; 493/313

(58) Field of Classification Search ..... 271/90, 271/91, 23, 21, 99, 100, 102, 103, 107, 95; 493/313, 315
See application file for complete search history.

(56) References Cited

U.S. PATENT DOCUMENTS

| | | | | |
|---|---|---|---|---|
| 3,575,409 | A | | 4/1971 | Calvert |
| 3,795,302 | A | | 3/1974 | Schoppee |
| 3,882,998 | A | | 5/1975 | Hunter |
| 3,937,458 | A | | 2/1976 | Langen |
| 3,956,976 | A | | 5/1976 | Vogel et al. |
| 4,194,442 | A | | 3/1980 | Martelli |
| 4,429,864 | A | | 2/1984 | Scarpa et al. |
| 4,511,134 | A | | 4/1985 | Hughes |
| 4,582,315 | A | | 4/1986 | Scarpa et al. |
| 4,596,545 | A | | 6/1986 | Greenwell |
| 4,601,691 | A | | 7/1986 | Greenwell |
| 4,643,633 | A | | 2/1987 | Lashyro |
| 4,779,860 | A | | 10/1988 | Scarpa |
| 4,830,172 | A | | 5/1989 | Hilton et al. |
| 4,871,348 | A | * | 10/1989 | Konaka ..... 493/315 |
| 4,881,934 | A | | 11/1989 | Harston et al. |
| 4,934,682 | A | | 6/1990 | Rece et al. |
| 5,019,029 | A | | 5/1991 | Calvert |
| 5,028,044 | A | | 7/1991 | Fischer |
| 5,037,018 | A | | 8/1991 | Matsuda et al. |
| 5,038,919 | A | | 8/1991 | Harston |
| 5,061,231 | A | | 10/1991 | Dietrich et al. |
| 5,067,937 | A | | 11/1991 | Aschaber |
| 5,102,385 | A | | 4/1992 | Calvert |
| 5,105,931 | A | | 4/1992 | Lashyro |
| 5,176,612 | A | | 1/1993 | Calvert et al. |

(Continued)

FOREIGN PATENT DOCUMENTS

DE 199 09 754 A1 9/2000

(Continued)

*Primary Examiner*—Patrick H Mackey
*Assistant Examiner*—Luis Gonzalez
(74) *Attorney, Agent, or Firm*—Womble Carlyle Sandridge & Rice, PLLC

(57) ABSTRACT

A carton feeding system for feeding a series of cartons into selected flights of a carton conveyor is disclosed. The carton feeding system generally includes a rotary feeder having a series of carton feeding assemblies rotated thereabout. The carton engaging assemblies are attached to a gearing system or mechanism that controls the operating angle of the carton engaging assemblies as they engage or pick the cartons from a magazine or supply. Thereafter, the cartons are erected within the flights of a carton conveyor moving beneath the rotary feeder as the carton engaging elements are carried about their path of travel.

10 Claims, 5 Drawing Sheets

U.S. PATENT DOCUMENTS

| | | | | |
|---|---|---|---|---|
| 5,215,515 | A | 6/1993 | Bershadsky | |
| 5,249,916 | A | 10/1993 | Portrait et al. | |
| 5,254,071 | A | 10/1993 | Laroche | |
| 5,346,050 | A | 9/1994 | Mojden et al. | |
| 5,426,920 | A * | 6/1995 | Quadalti | 53/564 |
| 5,452,568 | A | 9/1995 | Tisma | |
| 5,456,570 | A | 10/1995 | Davis, Jr. et al. | |
| 5,514,068 | A | 5/1996 | Calvert | |
| 5,536,231 | A | 7/1996 | Nilsson | |
| 5,632,368 | A | 5/1997 | Moncrief | |
| 5,657,610 | A | 8/1997 | Dietrich et al. | |
| 5,662,577 | A | 9/1997 | Reuteler | |
| 5,664,407 | A | 9/1997 | Cooper et al. | |
| 5,852,912 | A | 12/1998 | Chalendar | |
| 5,910,078 | A | 6/1999 | Guttinger et al. | |
| 5,937,992 | A | 8/1999 | Davis | |
| 6,050,063 | A | 4/2000 | Ford et al. | |
| 6,073,423 | A | 6/2000 | House | |
| 6,168,149 | B1 | 1/2001 | Boldrini | |
| 6,170,237 | B1 | 1/2001 | Wipf | |
| 6,179,004 | B1 | 1/2001 | Davis, Jr. | |
| 6,311,457 | B1 | 11/2001 | May et al. | |
| 6,383,123 | B1 | 5/2002 | Ehring | |
| 6,550,608 | B1 | 4/2003 | Brown et al. | |
| 6,575,886 | B1 | 6/2003 | Tanck et al. | |
| 6,993,889 | B2 | 2/2006 | Ford et al. | |
| 7,040,479 | B2 | 5/2006 | Fochler | |
| 2008/0227612 | A1 | 9/2008 | Harston | |

FOREIGN PATENT DOCUMENTS

| | | | |
|---|---|---|---|
| EP | 0 331 325 | A | 9/1989 |
| EP | 1 388 495 | A1 | 2/2004 |
| GB | 2 198 711 | A | 6/1988 |
| WO | WO 03/020615 | A2 | 3/2003 |
| WO | WO 2007/015049 | A1 | 2/2007 |

* cited by examiner

ROTARY CARTON FEEDER

FIELD OF THE INVENTION

The present invention generally relates to packaging systems for packaging articles in containers or cartons. In particular, the present invention relates to a carton feeding system for consistently picking, opening, and depositing cartons within the flights of a flighted conveyor, which feeder is able to accommodate a range of varying sizes and/or configurations of cartons.

BACKGROUND OF THE INVENTION

In the automated packaging of goods such as soft drink cans, pouches, and other similar products into cartons or boxes, the cartons typically can be fed from a stack or supply of preglued carton sleeves, opened, and deposited on a carton conveyor prior to being fed into a product packaging machine. The cartons generally will be deposited within the flights of a carton conveyor with the products thereafter being inserted through the open ends of the carton sleeve. Thereafter, the end flaps of the cartons are folded and typically adhesively attached to seal the ends of the cartons. The cartons often are fed into the flights of the carton conveyor for a packaging machine by a rotary style carton feeder. Such rotary feeders typically will include a series of vacuum cups that are rotated about a carton path for picking individual cartons from a stack or supply of cartons, and rotating the cartons downwardly and into a flight of the carton conveyor moving therebelow.

Such conventional rotary feeders tend to have a fixed geometry, however, which limits their path of movement, and thus limits the size or range of sizes of cartons that can be fed and/or deposited into the flights of the carton conveyor. To feed different size cartons, it therefore generally has been necessary to adjust or reconfigure the feeder elements of most conventional rotary feeders, and/or adjust the height or position of the feeder to accommodate the feeding of tall, narrow cartons or shorter, wider cartons as necessary. Such adjustments are needed to ensure that there will be a sufficiently deep draw and/or pick of the cartons to enable the cartons to be sufficiently opened by the time they are deposited in the next selected flight of the carton conveyor, as well as to ensure that the vacuum cups of the rotary feeder, will not interfere with or engage the lugs of the carton flights as the cartons are deposited therein.

Accordingly, it can be seen that a need exists for a carton feeder that addresses the foregoing and other related and unrelated problems in the art.

SUMMARY OF THE INVENTION

Briefly described, the present invention generally relates to a rotary carton feeder for engaging, opening, and depositing cartons or other similar articles into selected flights of a flighted conveyor passing therebeneath. The carton feeder of the present invention is designed to accommodate and enable feeding of a variety of different sizes or configurations of cartons or similar articles into varying height or size flights of a flighted conveyor such as a carton conveyor for a packaging machine.

The carton feeder generally includes a frame mounted along the carton conveyor and including pairs of spaced disks or plates, with one of the plates of at least one of the feeder supports including a cam track formed on an interior facing surface thereof. A series of carton engaging assemblies are mounted on rocker arms of at least one rocker element attached to and driven by a central shaft so as to move the carton engaging assemblies about a generally circular path of travel about the rotary feeder. The carton engaging assemblies are moved about their path of travel between a pick point or position, wherein the cartons each are engaged and picked from a carton supply or carton magazine, and a loading position in which opened cartons are deposited within a selected flight of the carton conveyor.

Each of the carton engaging assemblies typically includes a feed bar having one or more spaced vacuum cups mounted therealong. The feed bar is attached to and carried by a linkage arm attached to an associated rocker arm mounted on the central shaft of the feeder so as to move or orient the vacuum cups of each carton engaging assembly into an attitude to engage the cartons as each carton engaging assembly is moved about its path of travel about the feeder. The feed bar further generally is attached to a feed bar arm, which itself is connected at its opposite end to a pinion gear. The pinion gear of each carton engaging assembly engages a segment gear that is mounted on a cam arm having a cam follower at its free or distal end. The cam follower rides along the cam track formed in at least one of the feeder supports, so as to cause a pivoting or rotating movement of the segment gear, which in turn engages and rotates the pinion gear. As a result, the operating or approach angle of the vacuum cups with respect to the carton face to be engaged by the vacuum cups is amplified.

Accordingly, as the vacuum cups of each of the carton engaging assemblies approach the cartons contained within the magazine, the vacuum cups are moved into a position to engage the forward, flat face of the next carton within the magazine. At the same time, the radial position of the vacuum cups is controlled and varied by the rotation of the pinion gear attached to the feed bar arm upon engagement with its segment gear. As a further result of the cooperative action of the gear mechanism and oscillating movement of the rocker element, the dwell time of the engagement of the vacuum cups with the front face of the carton being picked can be increased to enable a greater draw or picking of the carton radially inwardly and away from the magazine to ensure that the cartons will be picked cleanly from the magazine, even where taller or thinner cartons are being engaged.

Thereafter, as the carton is pivoted downwardly toward the carton conveyor, the opening of the carton is initiated. As the carton is moved into engagement with the front or forwardmost lugs of a selected flight of the carton conveyor, the continued forward movement of the feeder running at a slightly faster speed than the movement of the carton conveyor causes the carton to engage the lugs and be opened as the carton is deposited between the lugs of the selected flight. As the carton is substantially opened, the vacuum applied thereto by the vacuum cups generally can be discontinued as the vacuum cups thereafter are moved upwardly and away from the carton face to avoid engagement with the front lugs of the flight. In addition, one or more skids and/or hold down elements can be attached to the feeder and feed bar of each carton engaging assembly, respectively, to engage and bear against the carton to help maintain the carton in an opened configuration as it is carried away by the carton conveyor.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
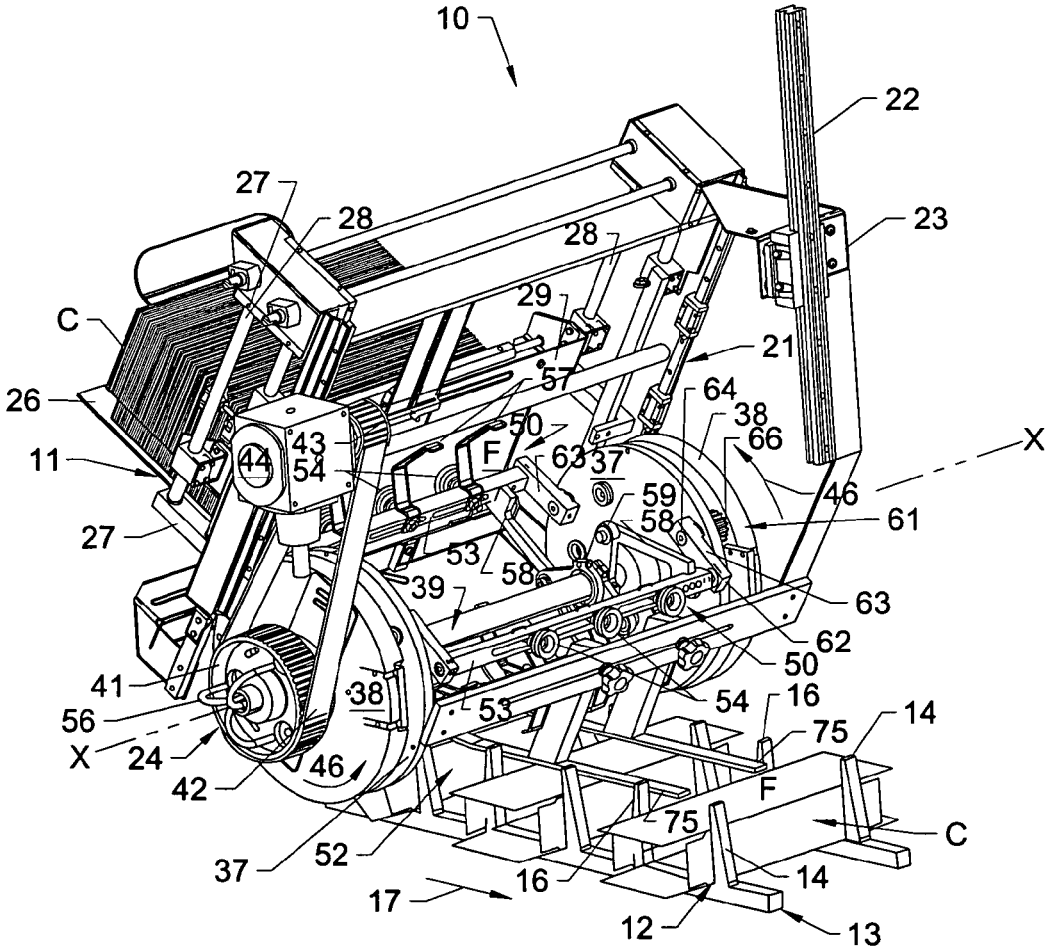
FIG. 1 is a perspective illustration of the rotary feeder of the present invention.

Referring now to the drawings in which like numerals indicate like parts throughout the several views, FIGS. 1-5 illustrate the system and method for feeding cartons according to the principles of the present invention. As generally illustrated in FIGS. 1-4, the system for feeding cartons of the present invention generally includes a rotary feeder 10 that engages and picks cartons C from a supply of cartons stacked in a generally flat lying attitude within a magazine 11, or similar carton support. The cartons C thereafter are opened and deposited within the flights 12 of a flighted conveyor such as a carton conveyor 13 for a packaging machine (not shown) as the rotary feeder is rotated. The cartons typically are paperboard cartons for use in packaging articles such as cans, bottles, pouches, or other product, although other similar types of articles also can be fed. The cartons generally will be picked from the magazine and opened or unfolded into an opened ended sleeve configuration, such as illustrated in FIG. 1, as they are deposited between the front and rear lugs 14 and 16, respectively, of a selected flight 12 of the carton conveyor 13. Thereafter, the cartons will be carried downstream by the carton conveyor in the direction of arrows 17 and into the product-packaging machine. The rotary feeder 10 further typically will be positioned upstream from an inlet end of the product-packaging machine as part of the overall product packaging line for the opening and feeding the cartons C in to the packaging machine.

It will be understood by those skilled in the art that the present invention can be used for feeding and opening cartons of varying sizes including beverage containers, cartons for beverage containers such as 6, 8, 12, or even 24 packs, and further can be used for opening and feeding a variety of other, different sizes or configurations of cartons, such as narrow, tall cartons (i.e. "pizza boxes"), or shorter and wider cartons such as for packaging juice pouches, etc., into varying size flights of the carton conveyor without requiring substantial adjustment or reconfiguration of the rotary feeder to accommodate such different sized cartons while avoiding interference with the tallest height lugs of the carton conveyor. The carton feeder of the present invention further enables the feeding of varying sizes of cartons into taller or deeper flights without requiring the changing or replacement of the lugs to feed shorter or smaller cartons.

Figure 2:
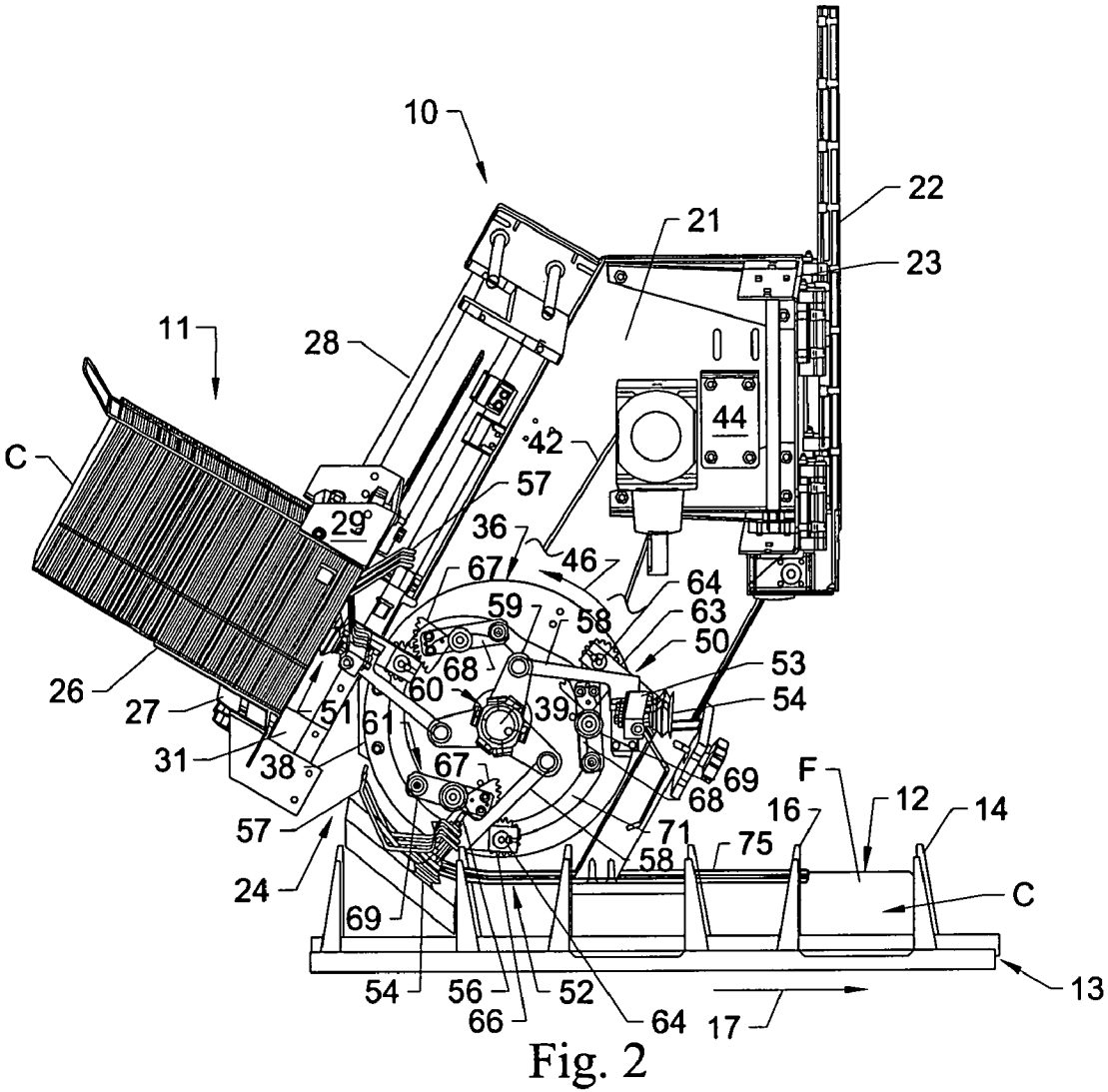
FIG. 2 is a side elevational view, with parts broken away, of the rotary feeder of FIG. 1.

The rotary feeder generally includes a frame 21 that is supported above the carton conveyor 13 by one or more vertical supports 22 attached to the frame 21 of the rotary feeder 10 by brackets 23. The position of the rotary feeder is adjustable along the vertical supports 22 to enable adjustment of the position of the rotary feeder with respect to the lugs of the carton conveyor 13 passing therebeneath. The magazine 11 generally is mounted along an upstream side or edge 24 of the rotary feeder, and typically includes an adjustable shelf or platform 26. As illustrated in FIGS. 1 and 2, the platform 26 generally is mounted on a pair of brackets 27 that are slidable upon magazine support rods 28 supported from the frame 21 of the rotary feeder 10, so as to raise and lower the magazine as needed to accommodate varying size or height cartons in the stack thereon. As further illustrated in FIG. 2, the cartons C generally will be captured between upper and lower guides 29, 31 to help hold the cartons within the magazine until engaged and picked by the rotary feeder.

As shown in FIGS. 1 and 2, the frame of the rotary feeder 10 further includes spaced feeder frame side plates, each of which generally can include spaced, substantially circular inner or first and outer or second plates 37 and 38. The pairs of inner and outer plates 37, 38 of each of the feeder supports are positioned at opposite ends of a central drive shaft 39. The outer plates 38 generally are mounted to the frame 21 so that they typically remain stationary, while the inner or first plates 37 are attached to a centrally extending drive shaft 39 so as to be rotated therewith. As further illustrated in FIG. 1, a drive pulley 41 is mounted to one end of the central drive shaft 39, positioned along an outer facing surface of one of the outer plates 38. The drive pulley 41 is driven by a drive belt 42 that is extended thereabout, and which further extends about and is driven by a drive pulley 43 mounted on a drive shaft of a driver gearbox 44 for the rotary feeder. The pulley 43 drives the drive belt 42, and thus the drive pulley 41, to in turn drive the central drive shaft 39 and thus cause the innermost or first plates 37 to be rotated in the direction of arrows 46 in FIG. 1.

Figure 3:
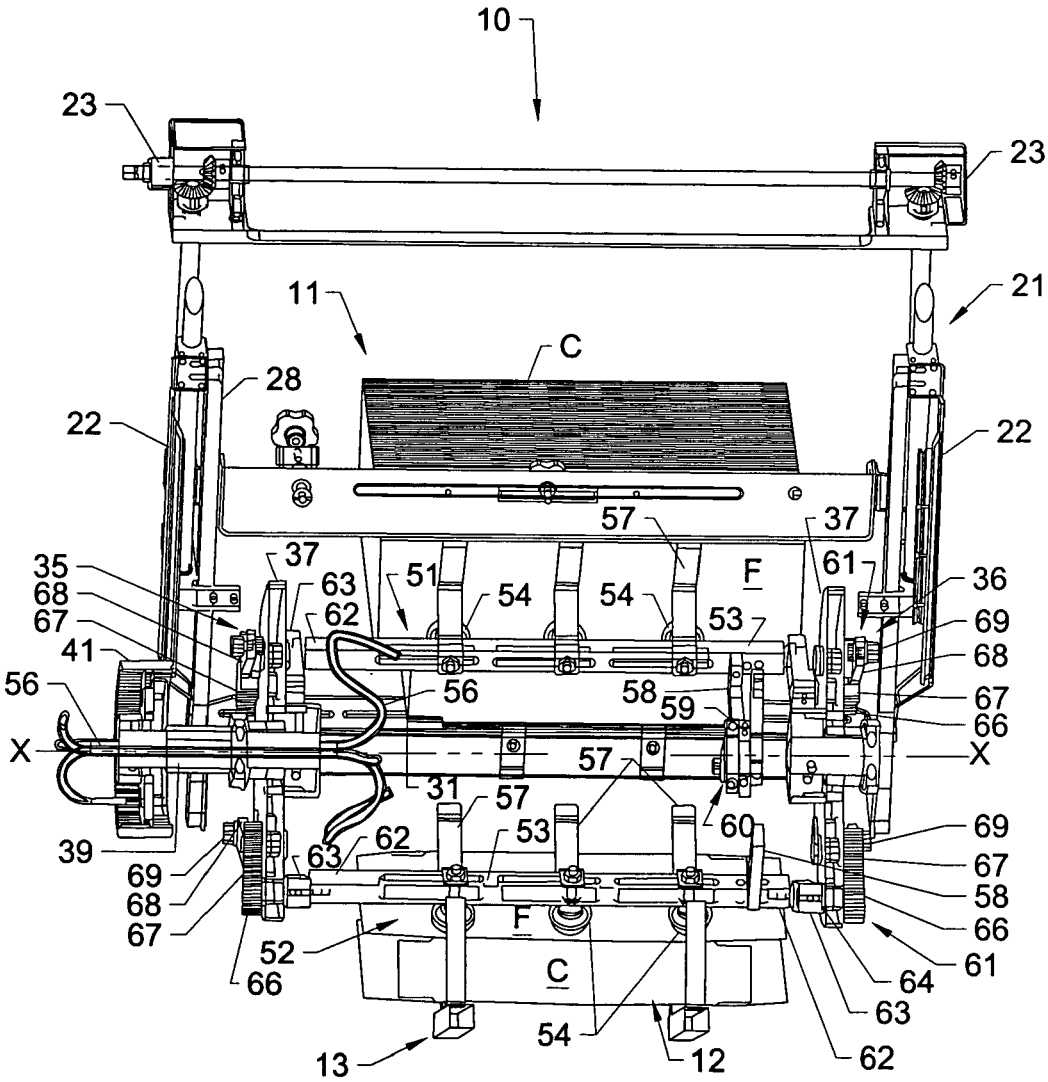
FIG. 3 is an end elevational view, taken in partial cross section, of the rear end of the rotary feeder downstream from the magazine.
Figure 4:
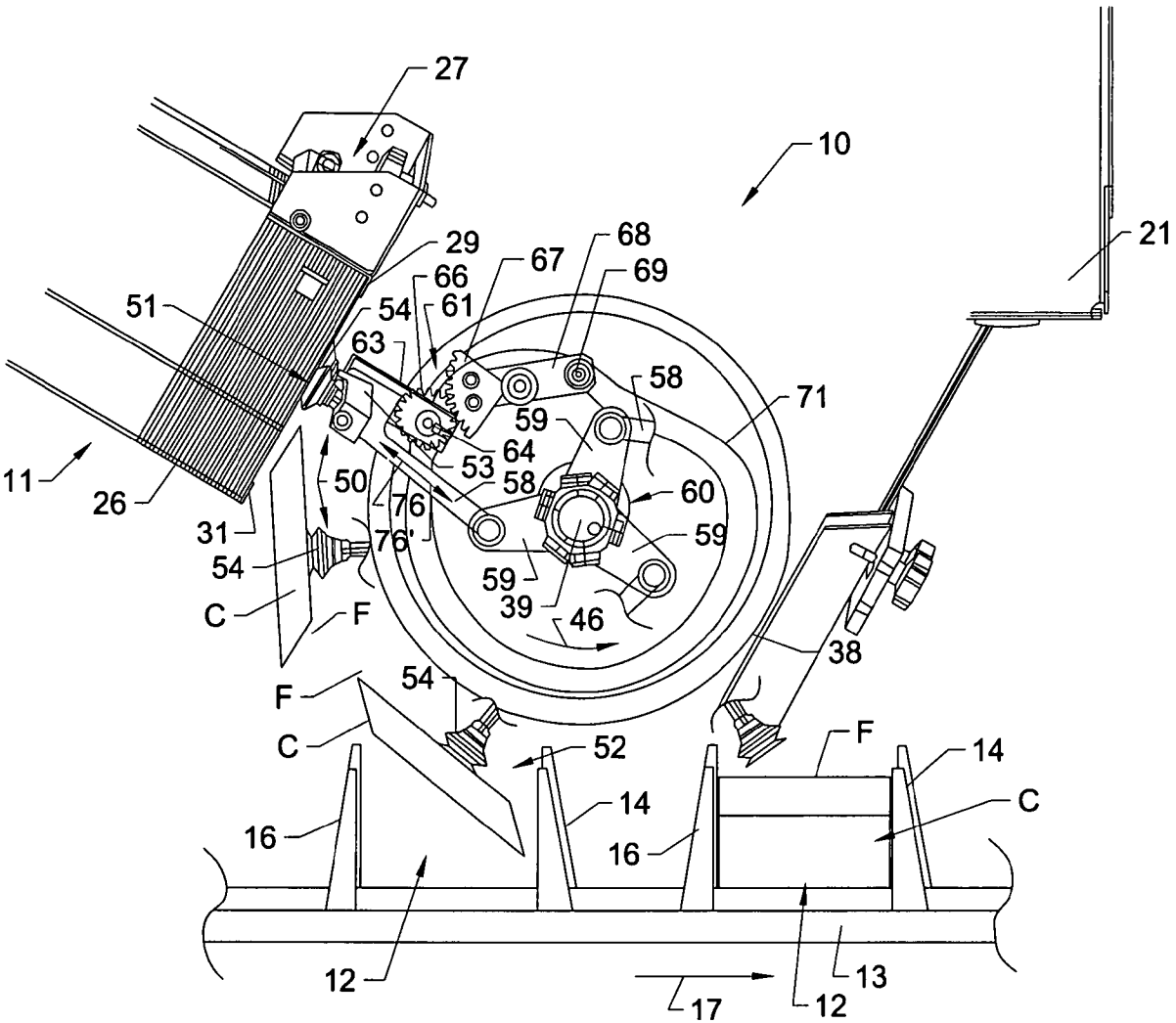
FIG. 4 is a schematic illustration of the operation of a carton engaging assembly of the rotary feeder engaging a carton and illustrating the radial and pivoting movements of the carton engaging assemblies by their linkage arm and segment and pinion gears.
Figure 5:
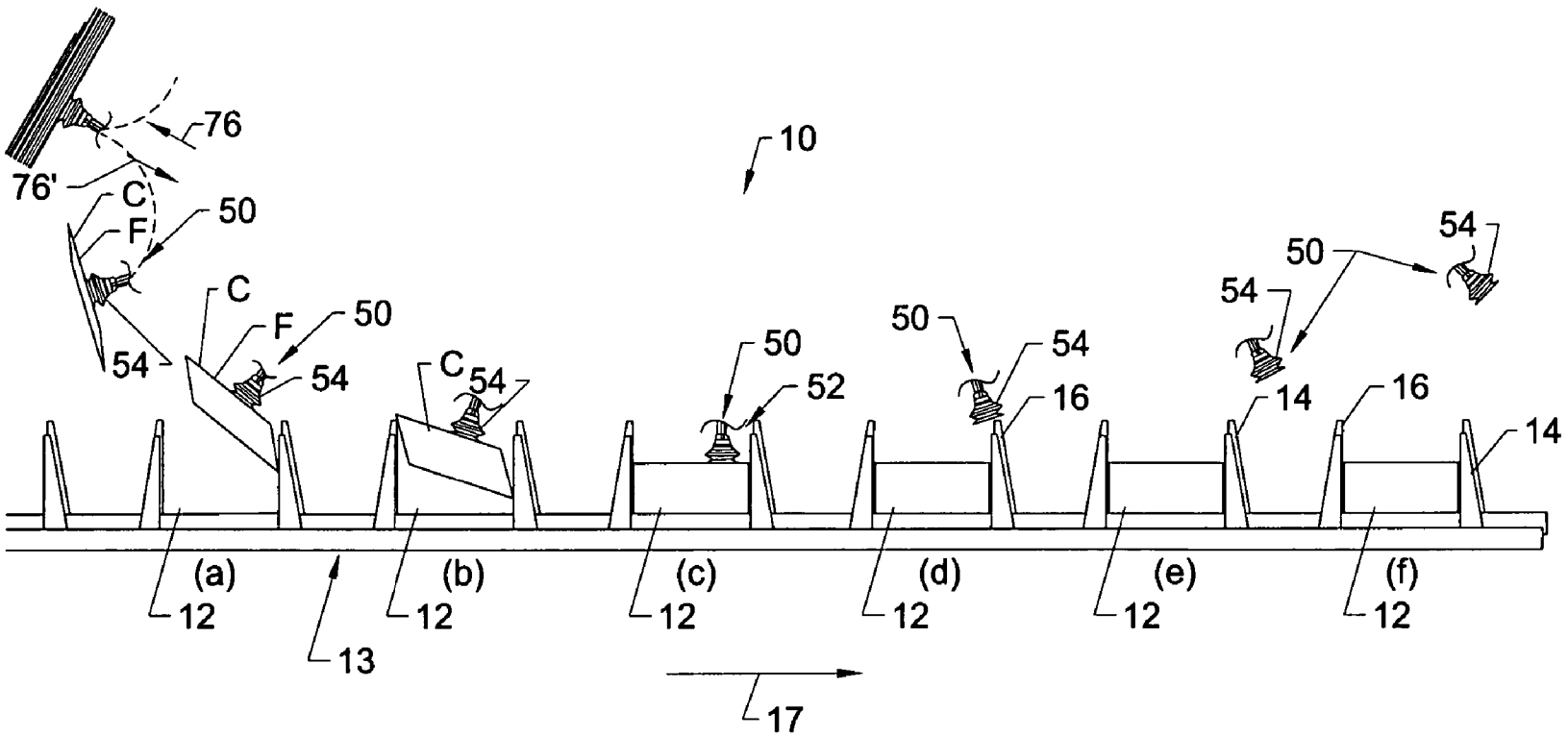
FIG. 5 shows a sequential series of views illustrating the opening and depositing of cartons in the flights of the carton conveyor according to the method of the present invention.

As generally illustrated in FIGS. 1-4, a series of carton engaging assemblies 50 are connected to and more in timed relation with the rotation of the inner or first plates 37 as they are moved along a path of travel in the direction of the arrows 46 in FIGS. 1, 2 and 4. The carton engaging assemblies are thus moved about a substantially circular path of travel, moving between an engaging or pick point or position, generally indicated at 51 in FIGS. 1, 2 and 4, wherein the carton engaging assemblies engage a front face F of the next carton in the carton C in the magazine 11 and pull the carton therefrom, and a loading position, generally indicated by 52, where the opened carton is deposited within a selected flight 12 of the carton conveyor 13, as generally illustrated in FIGS. 2, 4 and 5. In typical operation, there can be three to four carton-engaging assemblies mounted on and moving about a path of travel 46 about the rotary feeder. It will, however, be understood by those skilled in the art that fewer or greater number of carton engaging assemblies also can be used with the rotary feeder as needed depending on the size of the cartons to be loaded and the loading or operational speed of the rotary feeder. The ability to achieve various radial positions using alternative cams allows the feeder to erect cartons in carton conveyors 13 of a variety of different pitches.

Each of the carton engaging assemblies 50 generally includes a feed bar 53, which typically is an elongated, laterally extending rod or bar and will include a series of vacuum cups 54 mounted in spaced series therealong. As indicated in FIG. 3, there can be three to four vacuum cups mounted across each of the feed bars 53, although more or fewer vacuum cups 54 also can be used, depending on the size of the cartons being picked. The positions of the vacuum cups 54 along their feed bar 53 further can be adjusted as needed to match the cartons being picked and fed. Vacuum hoses or lines 56 generally will be attached to the vacuum cups 54 to supply a vacuum or suction force to the face of each carton upon engagement by the vacuum cups, and while the vacuum cups pull and carry each carton toward the carton conveyor. One or more hold down elements 57 also can be mounted to each feed bar adjacent the vacuum cups 54, with each hold down element generally comprising an angled bar or plate projecting rearwardly from the feed bar. The hold down elements 57 engage and move across the front face of the carton as the carton is deposited within its flight and the suction applied by the vacuum cup is released, so as to hold down the carton within its flight as the vacuum cups are moved upwardly and away from the flight, as indicated in FIG. 2.

As further illustrated in FIGS. 1, 2 and 4, each feed bar 53 of each carton engaging assembly 50 generally will be connected at one or both ends to a linkage arm 58 that in turn is connected to a rocker arm 59 of rocker element 60 that is mounted on and free to pivot about the central drive shaft 39. As the feed bars 53 are driven around, the attitude of the vacuum cups 54 and thus the carton C is controlled by rocker elements 60 where rocker arms 59 pivot about the central drive shaft 39. This allows the attitude of the vacuum cups 54 and carton C to be maintained substantially square at the pick point 51 as the carton is pulled from the magazine 11 and further tends to cause rotation of the carton as the carton C enters its flight 12 to assist opening the carton. Thereafter, as the cartons are deposited within a selected flight of the carton conveyor, the carton engaging assemblies are moved upwardly and away from engagement with the lugs of the carton conveyor to avoid interference therewith by the continued rotational motion of the rocker elements.

In addition, the ends 62 of each of the feed bars 53 generally are attached to a gear mechanism 61 for controlling and amplifying the operating or approach angle of the vacuum cups of the carton engaging assemblies as they are moved toward the carton magazine in their pick position. Each gear mechanism 61 generally includes feed bar arms 63 that are attached to the feed bars at one end and to the inner plates 37 of each of the feeder supports by pivot pins 64. As indicated in FIG. 3, the pivot pins 64 of each of the feed bar arms 63 extend through the inner plates 37 and are connected on the opposite sides of the plates 37 to pinion gears 66 (FIG. 2). Each of the pinion gears 66 is itself engaged by a segment gear 67 attached to a first or proximal end of a gear arm 68, that itself is pivotally attached to the inner plate 37. Inner plates 37 are rotatably driven by the central drive shaft 39 in the direction of arrows 46, driving gear mechanism 61 around. A cam follower 69 is attached to the distal or free end of each gear arm 68, and engages and moves along a cam track 71 formed into the outer or second plate 38 mounted to frame 21.

The movement of the cam followers 69 along the cam tracks 71 causes the segment gears 67 to be pivoted upwardly and downwardly depending on the slope of the cam track. In response, the engagement of the segment gears 67 with the pinion gears 66 causes rotation of the feed bar arms 63 so as to accordingly adjust or vary the path, and thus the radial position, of the vacuum cups 54 of each of the carton engaging assemblies with respect to the front face F of the next carton C in the magazine. This causes the carton engaging assemblies 50 to move about the path of travel 46 and to be reciprocated or oscillated radially inwardly and outwardly from a centerline or central axis "X" (FIGS. 1 and 3) of the rotary feeder, toward and away from the cartons to cause the cartons to be picked and pulled from the magazine.

As a result, the point at which the vacuum cups will engage the front face of the carton can be amplified to increase engagement time, and the dwell time during which the cartons are picked and pulled inwardly out of the magazine prior to beginning their downward movement toward the carton conveyor further can be increased and/or amplified to ensure clean picking and opening of the cartons even where taller or thinner cartons are being fed, without requiring significant adjustment or reconfiguration of the rotary feeder to accommodate such varying sizes of cartons. As a further result, taller lugs can be used for the carton conveyor as needed for receiving the tallest cartons being fed, with the rotary feeder 10 being able to feed a variety of different size cartons therein, without requiring replacement of the lugs to run such varying size or height cartons.

In addition, one or more skids or rails 75 can be mounted between the side plates of the frame 21, typically spaced inwardly of the lugs of the carton conveyor and between vacuum cups 54. These skids or rails generally will engage at the top or upper faces F of the cartons C once the cartons have been fully opened and deposited within the flights of the carton conveyor so as to help hold down the cartons and prevent the cartons from folding back into a substantially flat, unopened condition. The skids further help prevent the cartons from being pulled upwardly as the vacuum is released by the vacuum cups and the vacuum cups are thereafter moved away from the flights of the carton conveyor.

In operation of the rotary feeder 10 of the present invention, the carton engaging assemblies 50 will be rotated about their path of travel, indicated by arrow 46, as shown in FIGS. 1, 2 and 4, toward their pick position 51 for engaging the front face F of the foremost or next carton C within the carton magazine 11. As each carton engaging assembly 50 approaches its pick position, the carton engaging assembly will be oscillated or moved radially toward the carton magazine by the operation of the gear mechanism 61 urging the carton engaging assembly 50 forwardly in the direction of arrow 76 (FIGS. 4 and 5). As each of the cam followers 69 (FIG. 4) is moved along its cam track 71, each segment gear 67 of the carton engaging assembly generally is pivoted downwardly. The engagement of the segment gears 67 with their pinion gears 66 causes the pinion gears to rotate and thus pivot the feed bar 53 so that the operating or approach angle of its vacuum cups 54 is adjusted and/or amplified to engage and maintain contact with the front face F of the next carton C in the magazine as the linkage bars urge the vacuum cups thereagainst. This operating or approach angle of the vacuum cups with respect to the carton magazine can be further amplified or adjusted by adjusting the gear ratio of the pinion and segment gears to provide further or lesser dwell time as needed depending on the cartons being fed.

Thereafter, as the gear mechanism 61 is further rotated, the cam follower 69 moving along cam track 71 will pull the carton engaging assembly 50 in the direction of arrows 76' (FIGS. 4 and 5) radially inwards and away from the magazine 11, while the continued engagement of the segment gear with the pinion gear continues to rotate the feed bar so as to maintain contact between the vacuum cups and front face of the carton to be picked. The linkage between the feed bars 53 (FIG. 4) and the rocker element 60 causes the carton to be pulled inwardly, in a substantially straight direction during the inward movement, to ensure that the carton will be picked substantially cleanly from the magazine and will clear the guides 29 and 31 at the upper and lower edges of the magazine. Thereafter, as indicated in FIG. 4, the carton will begin its downward motion toward a selected flight 12 of the carton conveyor 13 passing beneath the rotary feeder.

As indicated in FIG. 5, as the carton is moved downwardly, it enters the flight 12 and engages the forward lugs 14 of the flight. The further forward motion of the vacuum cup pushing the leading edge of the carton against the front lugs 14 of the flights, and the operation of the linkage between the feed bar 53 and the rocker element 60, changing the attitude of the vacuum cups 54, causes the carton to open. As the carton is being opened and placed in its flight, the top surface of the carton generally will be engaged by the skids or rails 75 therealong. Thereafter, the vacuum or suction being applied by the vacuum cups will be discontinued as the vacuum cups are then rotated further upwardly and radially inwardly by the continued rotational movement of the rocker element and linkage arms. At substantially the same time, the hold down elements 57 of the carton engaging assembly engage and press against the upper surface or face of the carton to help maintain the carton in a substantially opened condition as the vacuum cups are disengaged therefrom. In addition, the further movement of the cam followers along their cam tracks causes further pivoting movement of the vacuum cups away from the forward or foremost lugs of the flight in which the carton is being deposited as the carton engaging assembly is rotated away therefrom so as to ensure that the vacuum cups will not engage or interfere with the movement of the lugs of the carton conveyor. Thereafter, the opened cartons are transported or moved into the downstream product packaging machine as the carton engaging assemblies continue about their path in the direction of arrows 46 for picking and feeding further cartons.

It will be understood by those skilled in the art that while the present invention has been discussed above with reference to particular embodiments, various modifications, additions and changes can be made to the present invention without departing from the spirit and scope of the present invention.

What is claimed:

1. A system for feeding cartons from a magazine into flights of a carton conveyor, comprising:

a frame having a central shaft;

feeder supports mounted on said frame;

at least one carton engaging assembly carried along a path of travel between a carton pick position for engaging and removing the cartons from the magazine, and a loading position for depositing the cartons into selected flights of the carton conveyor;

at least one rocker arm connected to said at least one carton engaging assembly, and pivotable about said central shaft; and said at least one carton engaging assembly including a series of vacuum cups mounted along a feeder bar, a linkage connected to said feeder bar and to said at least one rocker arm and moveable radially for controlling pivoting of said feeder bar toward and away from the magazine and carton conveyor to control an operating angle of said vacuum cups; and a gear mechanism engaging said feeder bar for controlling oscillating movement of said vacuum cups so as to vary radial position of said vacuum cups with respect to the cartons in the magazine to control dwell time of said vacuum cups in engagement with the cartons to enable engagement and picking of cartons of varying sizes;

wherein said gear mechanism comprises a pinion gear connected to a feed bar arm attached to said feeder bar, and a segment gear adapted to engage and cause rotation of said pinion gear so as to adjust the radial position of said vacuum cups.

2. The system of claim 1 and further comprising a cam follower connected to said gear mechanism and adapted to engage and follow a cam track formed in at least one of said feeder supports as said at least one carton engaging assembly is moved about its path of travel to adjust the radial position of said at least one carton engaging assembly.

3. The system of claim 1 and further comprising a cam follower connected to said segment gear and adapted to engage a cam track formed in one of said feeder supports for causing movement of said segment gear as said cam follower moves along said cam track.

4. The system of claim 1 and further comprising a drive system for moving said at least one carton engaging assembly along its path of travel.

5. The system of claim 1 and wherein said feeder supports each comprise a pair of plates, with at least one of said plates being mounted to said central shaft for rotation in timed relation with the movement of said at least one carton engaging assembly about its path of travel.

6. The system of claim 1 and further comprising at least one skid extending along a portion of said path of travel of at least one carton engaging assembly adjacent said loading position for urging the cartons off said vacuum cups and into the flights of the carton conveyor.

7. A method of loading cartons from a magazine into flights of a carton conveyor, comprising:

varying a gear ratio between segment and pinion gears of a carton engaging assembly of a carton feeder to vary the radial position of vacuum cups of the carton feeder to adjust the operation of the carton feeder to load varying sizes of cartons;

moving the carton engaging assembly of the carton feeder about a path of travel between a pick position and a carton loading position;

as the carton engaging assembly approaches its pick position, oscillating the carton engaging assembly radially toward a next carton in the magazine;

as the carton engaging assembly is oscillated toward the carton, moving a cam follower along a cam track to vary and control radial position of the carton engaging assembly with respect to the carton in the magazine and control a dwell time of the engagement of the carton in the magazine by the vacuum cups as the carton is engaged to enable cartons of varying sizes to be picked from the magazine;

controlling an operating angle of the vacuum cups to orient the vacuum cups in a position for engaging the carton in the magazine;

picking and drawing the carton radially away from the magazine;

moving the carton toward engagement with a lug of a selected flight of the carton conveyor;

opening and depositing the carton in the selected flight of the carton conveyor; and moving the vacuum cups radially away from the selected flight as the carton is deposited therein.

8. The method of claim 7 and wherein picking and drawing the carton away from the magazine comprises engaging the carton with the vacuum cups and applying a vacuum thereto, and pulling the carton radially forwardly out of the magazine.

9. The method of claim 7 and wherein opening and depositing the carton in a selected flight comprises moving a leading edge of he carton against a forward lug of the flight to cause the carton to open and engaging the carton with a hold down element as the selected flight of carton conveyor is moved forwardly.

10. The method of claim 7 and further comprising discontinuing the vacuum and stripping the carton from the vacuum cups as the carton is deposited in the selected flight.

* * * * *